US008370136B2

(12) United States Patent
Dai et al.

(10) Patent No.: US 8,370,136 B2
(45) Date of Patent: Feb. 5, 2013

(54) METHOD AND APPARATUS FOR GENERATING NOISES

(75) Inventors: Jinliang Dai, Shenzhen (CN); Libin Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 222 days.

(21) Appl. No.: 12/886,151

(22) Filed: Sep. 20, 2010

(65) Prior Publication Data

US 2011/0015923 A1 Jan. 20, 2011

Related U.S. Application Data

(63) Continuation of application No. PCT/CN2009/070856, filed on Mar. 18, 2009.

(30) Foreign Application Priority Data

Mar. 20, 2008 (CN) ..... 2008 1 0085175

(51) Int. Cl.
*G10L 21/02* (2006.01)

(52) U.S. Cl. ..... 704/226

(58) Field of Classification Search ..... 704/226
See application file for complete search history.

(56) References Cited

U.S. PATENT DOCUMENTS

| | | | | |
|---|---|---|---|---|
| 7,529,325 | B2 * | 5/2009 | Li | 375/344 |
| 2003/0053553 | A1 | 3/2003 | Critchlow et al. | |
| 2003/0174661 | A1 * | 9/2003 | Lee | 370/286 |
| 2005/0143989 | A1 * | 6/2005 | Jelinek | 704/226 |

FOREIGN PATENT DOCUMENTS

| | | | |
|---|---|---|---|
| CN | 1155801 | A | 7/1997 |
| CN | 101080766 | A | 11/2007 |
| CN | 101087319 | A | 12/2007 |
| CN | 101207665 | A | 6/2008 |
| EP | 0531242 | A1 | 7/1997 |
| RU | 2138124 | C1 | 9/1999 |
| RU | 2151430 | C1 | 6/2000 |
| WO | WO 2007027291 | A1 | 3/2007 |
| WO | WO 2007111645 | A2 | 10/2007 |
| WO | WO 2008100385 | A2 | 8/2008 |

OTHER PUBLICATIONS

1st Office Action in corresponding Chinese Application No. 200810085175.1 (Jan. 8, 2010).

2nd Office Action in corresponding Chinese Application No. 200810085175.1 (Jun. 13, 2010).

Written Opinion of the International Searching Authority in corresponding PCT Application No. PCT/CN2009/070856 (Jun. 25, 2009).

(Continued)

*Primary Examiner* — Jakieda Jackson

(74) *Attorney, Agent, or Firm* — Leydig, Voit & Mayer, Ltd.

(57) ABSTRACT

A method and an apparatus for generating comfortable noises so as to improve user experience are disclosed. The method includes: if a received data frame is a noise frame, calculating a corresponding energy attenuation parameter based on the noise frame and a data frame received earlier than the noise frame; and attenuating noise energy based on the energy attenuation parameter to obtain a comfortable noise signal. An apparatus for generating comfortable noise is also provided.

13 Claims, 4 Drawing Sheets

OTHER PUBLICATIONS

"3GPP TS 26.092—Technical Specification Group Services and System Aspects; Mandatory speech codec speech processing functions; Adaptive Multi-Rate (AMR) speech codec; Comfort noise aspects (Release 6)," Dec. 2004, Version 6.0.0, 3rd Generation Partnership Project, Valbonne, France.

"3GPP TS 26.192—Technical Specification Group Services and System Aspects; Speech codec speech processing functions; Adaptive Multi-Rate—Wideband (AMR WB) speech codec; Comfort noise aspects (Release 6)," Dec. 2004, Version 6.0.0, 3rd Generation Partnership Project, Valbonne, France.

"G.729—Coding of speech at 8 kbit/s using conjugate structure algebraic-code-excited linear-prediction (CS-ACELP), Annex B: A silence compression scheme for G.729 optimized for terminals conforming to Recommendation V.70," Series G: Transmission Systems and Media, Digital transmission systems—Terminal equipments—Coding of analogue signals by methods other than PCM, Nov. 1996, International Telecommunication Union, Geneva, Switzerland.

"G.729.1—G.729 based Embedded Variable bit-rate coder: An 8-32 kbit/s scalable wideband coder bitstream interoperable with G.729," Series G: Transmission Systems and Media, Digital Systems and Networks, Digital terminal equipments—Coding of analogue signals by methods other than PCM, May 2006, International Telecommunication Union, Geneva, Switzerland.

Extended European Search Report in corresponding European Application No. 09722494.3 (May 30, 2011).

"G.729.1—G.729-based embedded variable bit-rate coder; an 8-32 kbit/s scalable wideband coder bitstream interoperable with G.729: New Annex C (DTX/CNG scheme) plus corrections to main body and Annex B, Amendment 4: New Annex C 'DTX/CNG scheme' plus correction to main body and Annex B," Jun. 2008, Series G: Transmission Systems and Media, Digital Systems and Networks, Digital terminal equipments—Coding of analogue signals by methods other than PCM, International Telecommunication Union, Geneva, Switzerland.

"G.729—Coding of speech at 8kbt/s using conjugate structure algebraic-code-excited linear-prediction (CS-ACELP), Annex B: A silence compression scheme for G.729 optimized for terminals conforming to Recommendation V.70," Nov. 1996, Series G: Transmission Systems and Media, Digital transmission systems—Terminal equipments—Coding of analogue signals by methods other than PCM, International Telecommunication Union, Geneva, Switzerland.

Decision on Grant of a Patent in corresponding Russian Patent Application No. 2010142929 (Jun. 5, 2012).

Office Action in corresponding Indonesian Patent Application No. HKI-3-HI.05.01.04.3281 (May 11, 2012).

The Federal Service for Intellectual Property, Office Action in Russian Application No. 2010142929/08 (Translated by Gorodissky & Partners of Moscow,), Mar. 18, 2009.

* cited by examiner

METHOD AND APPARATUS FOR GENERATING NOISES

CROSS-REFERENCE TO RELATED APPLICATIONS

This application is a continuation of International Application No. PCT/CN2009/070856, filed on Mar. 18, 2009, which claims priority to Chinese Patent Application No. 200810085175.1, filed on Mar. 20, 2008, both of which are hereby incorporated by reference in their entireties.

FIELD OF THE INVENTION

The present invention relates to the field of communications, and more particularly to a method and an apparatus for generating noises.

BACKGROUND

In the current data transmission systems, a speech coding technology may compress the transmission bandwidth of speech signals and increase the capacity of communications systems. Only about 40% of the contents in a speech communication include speech signal, and the rest of the contents that are transmitted are all silences or background noises. In order to further save the transmission bandwidth, Discontinuous Transmission System (DXT)/Comfortable Noise Generation (CNG) technologies are provided.

In the related art, one DXT strategy is to transmit a Silence Insertion Descriptor (SID) frame every several frames at a fixed interval. The CNG algorithm used in the DXT strategy utilizes parameters (including an energy parameter and a spectrum parameter) decoded from two received successive SID frames to perform linear interpolation, so as to estimate parameters required for synthesizing comfortable noises.

After the energy parameter and the spectrum parameter are reconstructed, the spectrum parameter is used for calculation of a synthesis filter and the energy parameter is used as the energy of an excitation signal. After the excitation signal is calculated, the synthesis filter performs filtering and outputs the reconstructed comfortable noises.

In the above solution, when the energy parameter is quantified at an encoding end, an attenuation of 3 dB is added so that the energy of the comfortable noise reconstructed according to the CNG algorithm at a decoding end is lower than an actual value. In a background noise stage, even if the energy of the actual background noise is relatively high, the generated comfortable noise may provide a relatively better subjective feeling for listeners.

However, the energy attenuation of 3 dB is added in a fixed manner, i.e., the same attenuation is applied to all of the background noises in the noise stage. Thus, when a speech stage is switched to the noise stage (or the noise stage is switched to the speech stage), the energy of background noises in a speech frame is high, while the energy of the comfortable noise reconstructed in the noise stage is low. The discontinuity of the energy can be recognized by the listeners clearly, which also affects the subjective feeling of the listeners brought by the reconstructed comfortable noise.

SUMMARY

The embodiments of the present invention provide a method and an apparatus for generating noises so as to improve user experience.

The method for generating noises according to the embodiments of the present invention includes the following steps: if a received data frame is a noise frame, calculating a corresponding energy attenuation parameter based on the noise frame and a data frame received earlier than the noise frame; and attenuating noise energy based on the energy attenuation parameter.

The apparatus for generating noises according to the embodiments of the present invention includes:

- an energy attenuation parameter calculating unit, configured to, if a received data frame is a noise frame, calculate a corresponding energy attenuation parameter based on the noise frame and a data frame received earlier than the noise frame; and
- an energy attenuating unit, configured to attenuate noise energy based on the energy attenuation parameter.

It can be seen from the above technical solutions that the embodiments of the present invention have the following advantages.

In embodiments of the present invention, when a received data frame is a noise frame, a corresponding energy attenuation parameter is calculated based on the noise frame and a data frame received earlier than the noise frame, and narrowband and/or highband noise energy is attenuated based on the energy attenuation parameter. Embodiments of the present invention are able to calculate the corresponding energy attenuation parameter based on the relationship between the current noise frame and the preceding data frame, and attenuate noise energy based on the energy attenuation parameter. This manner of energy attenuation is self-adaptive, and may be adjusted according to the condition of the data frame. Thus, a comfortable noise obtained by this manner of energy attenuation is relatively smooth, which facilitates the improving of user experience.

DETAILED DESCRIPTION

The embodiments of the present invention provide a method and an apparatus for generating noises so as to improve user experience.

In the embodiments of the present invention, when a received data frame is a noise frame, a corresponding energy attenuation parameter is calculated based on the noise frame and a data frame received earlier than the noise frame, and narrowband and/or highband noise energy is attenuated based on the energy attenuation parameter. Embodiments of the present invention enable the calculating of the corresponding energy attenuation parameter based on the relationship between the current noise frame and the preceding data frame, and attenuating noise energy based on the energy attenuation parameter. This manner of energy attenuation is self-adaptive, and may be adjusted according to the condition of the data frame. Thus, a comfortable noise obtained by this manner of energy attenuation is relatively smooth, which facilitates the improving of user experience.

The embodiments of the present invention also employ the DTX technology, so that an encoder can encode a background noise signal using coding algorithm and coding rate different from those for a speech signal, and thus the average coding rate is decreased. In brief, unlike the case of speech frame, in the DTX/CNG technology, when an encoding end encodes a segment of background noise, it is unnecessary to encode at full rate, and it is unnecessary to transmit coding information of each frame. Instead, only coding parameters (such as a SID frame) that are fewer than coding parameters of the speech frame are required to be transmitted every several frames. At a decoding end, the entire segment of background noise (i.e., comfortable noise) is recovered based on the received parameters of the discontinuous background noise frame. Relative to a normal speech coding frame, a noise coding frame, which encodes noise and is sent to a decoder, is generally referred to as a SID frame. The SID frame usually only contains a spectrum parameter and a signal energy gain parameter without any parameters associated with fixed codebook and self-adaptive codebook, so as to decrease the average coding rate.

Figure 1:
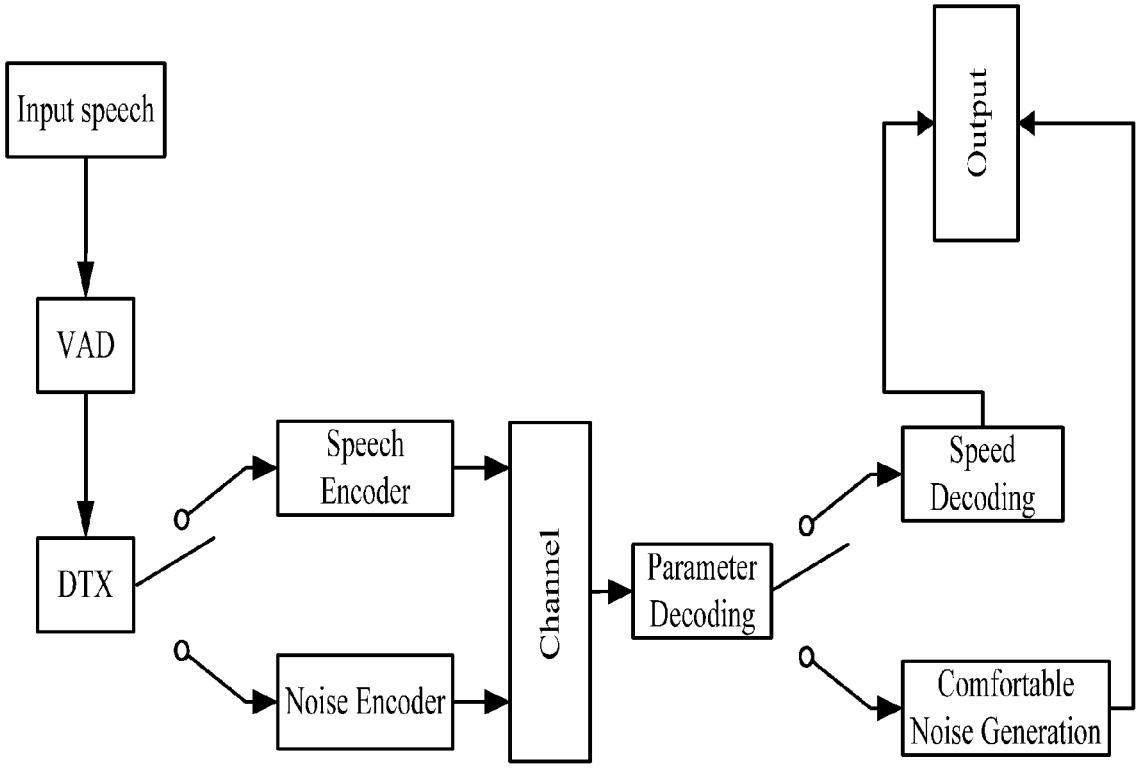
FIG. 1 is a schematic diagram of a speech codec system using the DTX/CNG technology according to an embodiment of the present invention.

A specific application scenario in the embodiments of the present invention is shown in FIG. 1. In FIG. 1, after a speech is inputted, the speech is processed by a Speech Activity Detector (VAD) and a DTX successively. Then a speech frame is continuously encoded at a full rate by a speech encoder, and a noise frame is discontinuously encoded at a non-full rate by a noise encoder. Then the encoded speech frame and the encoded noise frame are transmitted to a decoding end through a channel. The decoding end performs parameter decoding, performs speech decoding based on the speech frame, and generates a comfortable noise based on the noise frame. Then the decoding end outputs the result of speech decoding and the comfortable noise.

Figure 2:
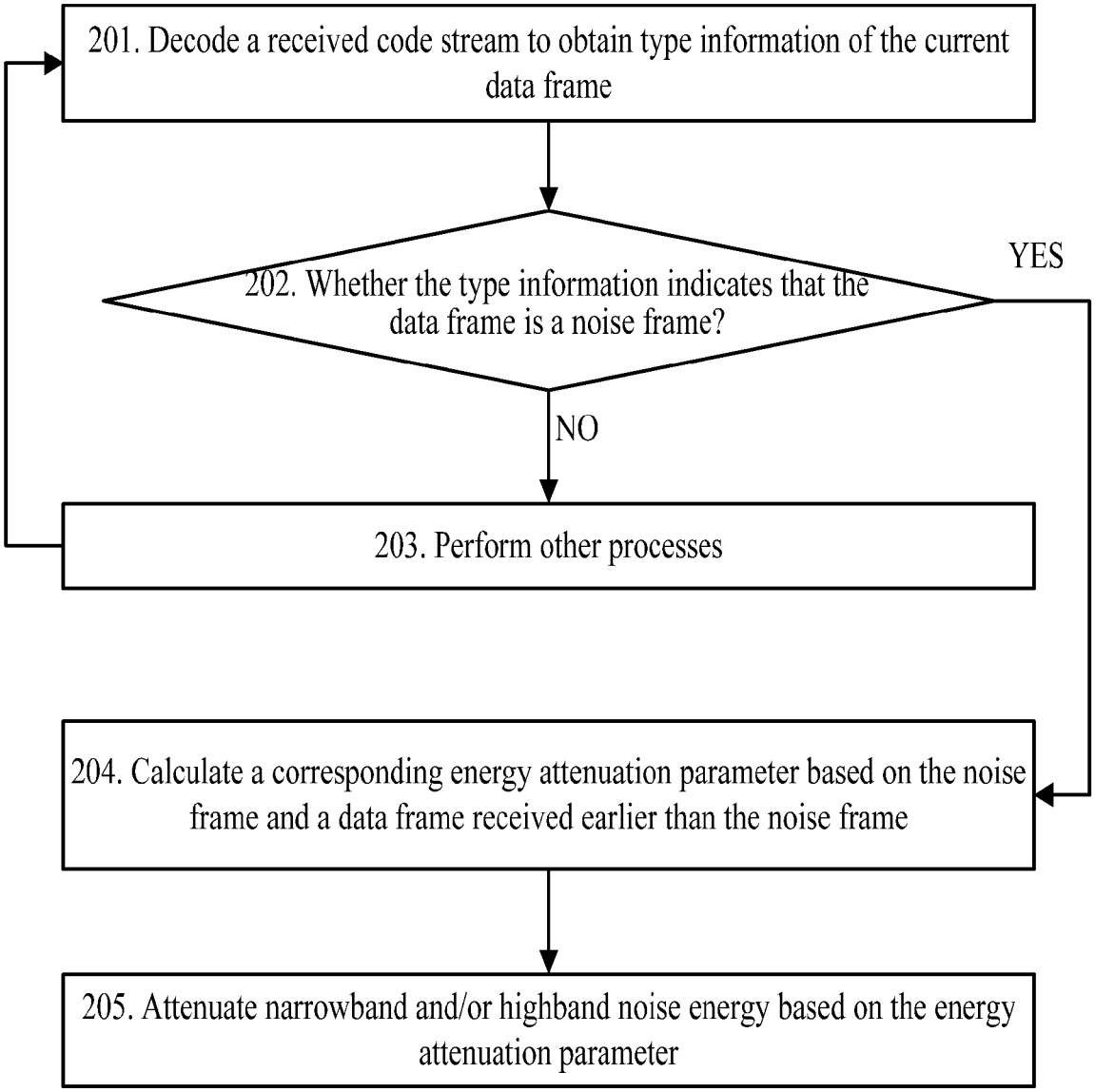
FIG. 2 is a flow chart of a method for generating noises according to an embodiment of the present invention.

Referring to FIG. 2, a method for generating noises according to an embodiment of the present invention includes the following steps.

Step 201: A received code stream is decoded to obtain type information of the current data frame. A decoder decodes the received code stream to obtain parameters and the type information of the current data frame. The type information is used to identify the current data frame as a speech frame or a noise frame. The decoder may determine whether the current data frame is a speech frame or a noise frame based on the type information.

Step 202: It is determined whether the type information indicates that the data frame is a noise frame. If the data frame is a noise frame, the process proceeds to step 204. If the data frame is not a noise frame, the process proceeds to step 203. In this embodiment, the decoder may determine whether the current data frame is a noise frame or a speech frame based on the obtained type information. If the data frame is a speech frame, the process proceeds to step 203. If the data frame is a noise frame, the process proceeds to step 204.

Step 203: Other procedures are performed, and the process returns to step 201. If the decoder recognizes from the type information that the current data frame is a speech frame, the decoder performs a corresponding process. A specific process may include updating a noise generation parameter, which is different from the following different embodiments. The updating process will be described in detail in the following embodiments. After the noise generation parameter is updated, the process returns to step 201 to continue decoding the code stream.

Step 204: A corresponding energy attenuation parameter is calculated based on the noise frame and a data frame received earlier than the noise frame. If the decoder recognizes from the type information that the current data frame is a noise frame, the decoder calculates the corresponding energy attenuation parameter based on the previously-received data frame and the current noise frame. There are three manners for the calculation, which will be described in detail in the following embodiments.

Specific structure of the noise frame is shown in the following table.

TABLE 1

| Parameter Description | Bit Allocation | Hierarchical Structure |
|---|---|---|
| LSF parameter quantizer index | 1 | Narrowband Core Layer |
| LSF quantization vector of the first stage | 5 | |
| LSF quantization vector of the second stage | 4 | |
| Energy parameter quantized value | 5 | |
| Time domain envelope of broadband component | 6 | Broadband Core Layer |
| Frequency domain envelope vector 1 of broadband component | 6 | |
| Frequency domain envelope vector 2 of broadband component | 6 | |
| Frequency domain envelope vector 3 of broadband component | 6 | |

Step 205: Noise energy is attenuated based on the energy attenuation parameter so as to obtain a comfortable noise signal. In this embodiment, the attenuation to noise energy includes attenuation to highband noise energy and attenuation to narrowband noise energy. It should be noted that, in practical applications, the attenuation may be performed on the highband noise energy only, or on the narrowband noise energy only, or on both the highband noise energy and the narrowband noise energy simultaneously. This embodiment and the following embodiments are illustrated with respect to the exemplary case that the attenuation is performed on both the highband noise energy and the narrowband noise energy simultaneously.

A narrowband and a highband constitute a broadband, where the broadband refers to the bandwidth of 0 to 8000 Hz, the narrowband refers to the bandwidth of 0 to 4000 Hz, and the highband refers to the bandwidth of 4001 to 8000 Hz. The above division manner of the narrowband and the highband is an exemplary case only, and in practical applications, the narrowband and the highband may de divided based on specific requirements.

Noise energy is divided into a narrowband signal component and a highband signal component, i.e., the comfortable noise signal generated by the decoder includes a narrowband signal component and a highband signal component.

Specific attenuation processes might be divided into two cases.

A: Energy Attenuation is Performed in Parameter Domain Before the Operations of Synthesizing and Filtering.

Figure 3:
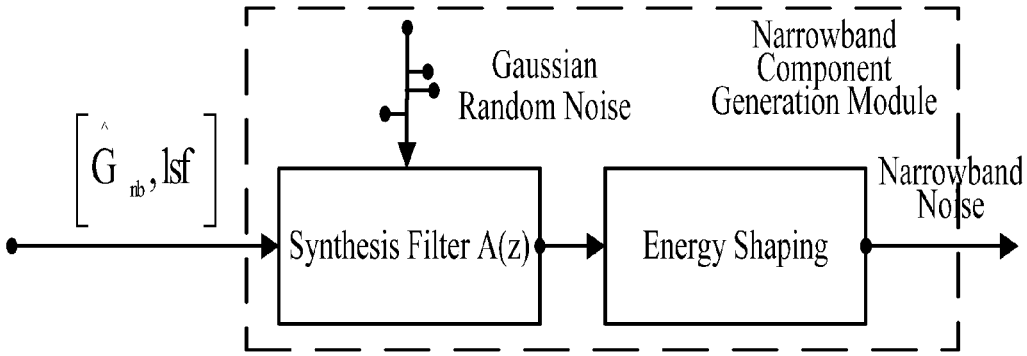
FIG. 3 is a flow chart for generating narrowband noises according to an embodiment of the present invention.

The comfortable noise is divided into the narrowband signal component and the highband signal component which will be described respectively. Referring to FIG. 3, in this embodiment, the flow for generating narrowband noise includes: acquiring an energy parameter of a narrowband core layer; multiplying the energy parameter of the narrowband core layer by the energy attenuation parameter to obtain the attenuated energy parameter of the narrowband core layer; and calculating an attenuated narrowband signal component based on the attenuated energy parameter of the narrowband core layer.

In order to facilitate the understanding of the solution, a specific example is described below.

First, it is assumed that the energy parameter of the narrowband core layer of a received SID frame is represented by $G_{nb}$ and a spectrum parameter of the narrowband core layer is represented by lsf.

The energy parameter of the narrowband core layer is attenuated based on the calculated energy attenuation parameter fact.

The attenuated energy parameter of the narrowband core layer is $\hat{G}_{nb}=G_{nb}$*fact and a reconstructed narrowband coding parameter is $\{\hat{G}_{nb}, lsf\}$.

The spectrum parameter [lsf] of the narrowband core layer is converted to a coefficient A(z) of a synthesis filter which utilizes a gaussian random noise as an excitation signal, filtered by the synthesis filter, and shaped by the energy of $\hat{G}_{nb}$, and thus a narrowband signal component $s_l(n)$ of background noise is generated.

Figure 4:
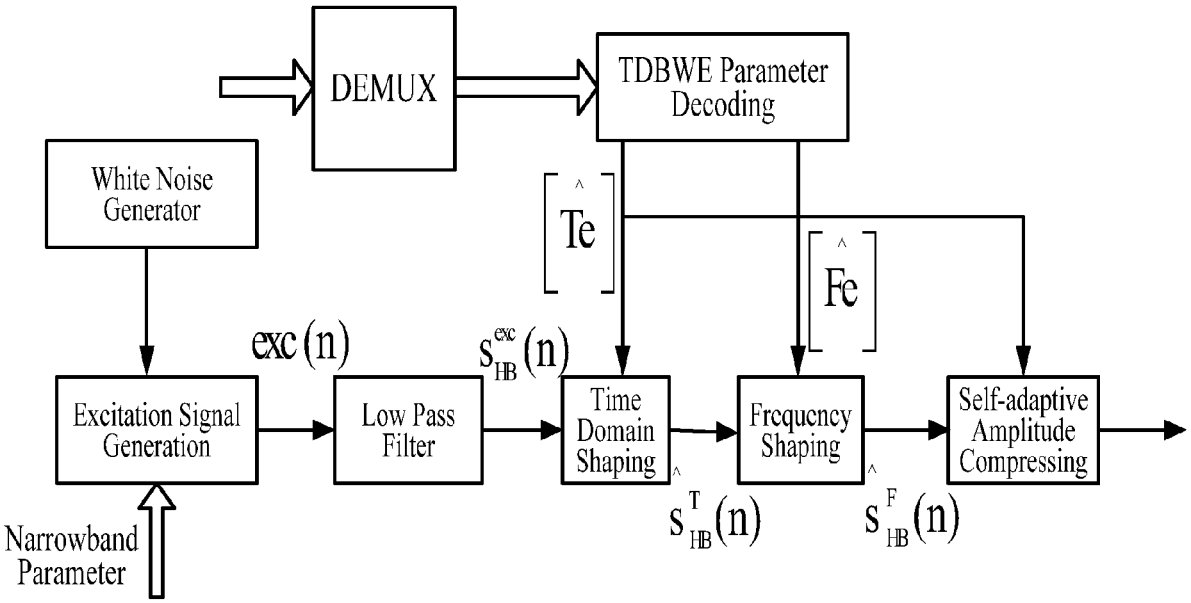
FIG. 4 is a flow chart for generating highband noises according to an embodiment of the present invention.

In this embodiment, the reconstructed narrowband coding parameter or the reconstructed narrowband signal component may be used to calculate a highband signal component. Referring to FIG. 4, in this embodiment, the flow for generating highband noise includes: acquiring a time domain envelope parameter of a highband core layer and a frequency domain envelope parameter of the highband core layer; multiplying the time domain envelope parameter of the highband core layer and the frequency domain envelope parameter of the highband core layer by the energy attenuation parameter respectively, to obtain the attenuated time domain envelope parameter of the highband core layer and the attenuated frequency domain envelope parameter of the highband core layer; and calculating an attenuated highband signal component based on the attenuated time domain envelope parameter of the highband core layer and the attenuated frequency domain envelope parameter of the highband core layer.

In order to facilitate the understanding of the solution, a specific example is described below.

Firstly, it is assumed that the time domain envelope of the broadband core layer is represented by Te, the frequency domain envelope of the broadband core layer is represented by Fe and the energy attenuation parameter is represented by fact.

The energy parameter of the narrowband core layer is attenuated based on the calculated energy attenuation parameter fact.

The attenuated time domain envelope of the broadband core layer is $\hat{T}e$=Te*fact and the attenuated frequency domain envelope of the broadband core layer is $\hat{F}e$=Fe*fact.

As shown in FIG. 4, firstly, narrowband parameters, such as pitch lag, fixed codebook gain, self-adaptive codebook gain, etc., are estimated by utilizing the reconstructed narrowband coding parameter or the reconstructed narrowband signal component. Then a white noise, which is generated by a random sequence generator, is properly shaped as an excitation source based on the estimated narrowband parameters, such as pitch lag, fixed codebook gain, self-adaptive codebook gain, etc. Then time domain shaping and frequency domain shaping are performed on the excitation source by utilizing the reconstructed broadband coding parameter $\{\hat{T}e, \hat{F}e\}$, and thus the highband signal component $S_h(n)$ of background noise is generated.

It should be noted that, if the received code stream contains both the narrowband coding parameter and the broadband coding parameter, the decoder would reconstruct the narrowband signal component $S_l(n)$ and the highband signal component $S_h(n)$ respectively, and then filter the narrowband signal component and the highband signal component by a group of synthesis filters so as to obtain a broadband comfortable noise $\hat{s}_{WB}(n)$.

The case of performing energy attenuation in parameter domain is described above. It should be noted that, in practical applications, energy attenuation may also be performed on a filtering result after the operation of filtering.

B: Energy Attenuation is Performed on a Filtering Result after the Operation of Filtering.

This manner includes: acquiring an energy parameter of a narrowband core layer, a spectrum parameter of the narrowband core layer, a time domain envelope parameter of a highband core layer and a frequency domain envelope parameter of the highband core layer; calculating a narrowband signal component based on the energy parameter of the narrowband core layer and the spectrum parameter of the narrowband core layer; calculating a highband signal component based on the time domain envelope parameter of the highband core layer and the frequency domain envelope parameter of the highband core layer; combining the narrowband signal component and the highband signal component to obtain a broadband signal component; and attenuating the broadband signal component based on the energy attenuation parameter.

Specifically, the narrowband signal component $s_l(n)$ and the highband signal component $s_h(n)$ are calculated based on the original energy parameter $G_{nb}$ of the narrowband core layer of a SID frame, the spectrum parameter lsf of the narrowband core layer, the time domain envelope parameter Te of the broadband core layer and the frequency domain envelope parameter Fe of the broadband core layer.

Then, the obtained narrowband signal component and highband signal component are synthesized and filtered to obtain a broadband comfortable noise signal $S_{WB}(n)$. Then energy attenuation is performed directly on the broadband comfortable noise signal $S_{WB}(n)$ by utilizing the energy attenuation parameter fact. Specifically, the product of the broadband comfortable noise signal and the energy attenuation parameter may be used as the attenuated broadband comfortable noise signal.

The case of attenuating the broadband comfortable noise signal is described above. However, in practical applications, the narrowband signal component and the highband signal component may also be attenuated respectively before being combined. The specific process includes: acquiring an energy parameter of a narrowband core layer, a spectrum parameter of the narrowband core layer, a time domain envelope parameter of the highband core layer and a frequency domain envelope parameter of the highband core layer; calculating a narrowband signal component based on the energy parameter of the narrowband core layer and the spectrum parameter of the narrowband core layer; calculating a highband signal component based on the time domain envelope parameter of the highband core layer and the frequency domain envelope parameter of the highband core layer; attenuating the narrowband signal component and the highband signal component respectively based on the energy attenuation parameter, to obtain the attenuated narrowband signal component and the attenuated highband signal component; and combining the attenuated narrowband signal component and the attenuated highband signal component to obtain an attenuated broadband signal component.

The case that the narrowband signal component and the highband signal component are attenuated simultaneously and then combined is described above. In practical applications, it is possible that only one of the narrowband signal component and the highband signal component is attenuated and then combined with the other so as to obtain the attenuated broadband comfortable noise signal.

It should be noted that, in practical applications, both or only one of the narrowband signal component and the highband signal component may be attenuated, which is not limited in this disclosure.

It should be noted that, in the embodiments of the present invention, noise energy may be attenuated at a decoding end or an encoding end. The case that noise energy is attenuated at the decoding end is described in the above embodiments. If noise energy is attenuated at the encoding end, the encoding end should attenuate noise energy in the same way as that in the above embodiments, and transmit the attenuated narrowband coding parameter and highband coding parameter to the decoding end. The decoding end calculates the attenuated narrowband signal component and highband signal component respectively based on the attenuated narrowband coding parameter and highband coding parameter, and combines the two components to obtain the broadband signal component.

It should be noted that, if noise energy is attenuated at the encoding end, after the attenuation is performed, a corresponding data frame is required to be transmitted to the decoding end. The specific process may include the following: the encoding end calculates an energy attenuation parameter and then transmits a data frame containing the energy attenuation parameter to the decoding end; and the decoding end attenuating noise energy based on the energy attenuation parameter in the received data frame to obtain a comfortable noise signal.

Alternatively, the encoding end may attenuate noise energy based on the calculated energy attenuation parameter and then transmit a data frame with the attenuated noise energy to the decoding end. The decoding end may generate a comfortable noise signal based on the data frame.

The process for generating the energy attenuation parameter in the embodiments of the present invention is described below.

According to an embodiment of the present invention, in the process for generating the energy attenuation parameter, the energy attenuation parameter is calculated based on a VAD switching frequency. The specific process includes: determining whether the type of the data frame is different from the type of a recently-received data frame earlier than the data frame; counting a switching frequency parameter if the type of the data frame is different from the type of the recently-received data frame earlier than the data frame; and setting a predetermined maximum hangover length to a hangover parameter if the type information indicates that the data frame is a speech frame, and progressively decreasing the hangover parameter until reaching a predetermined value if the type information indicates that the data frame is a noise frame.

Specifically, the decoder decodes the received code stream to obtain parameters, determines the type information of the current frame, and detects whether a switching of VAD occurs. If the preceding frame is a speech frame and the current frame is a noise frame, or if the preceding frame is a noise frame and the current frame is a speech frame, it is determined that the switching of VAD occurs, and then a VAD switching counter VadSw is increased by 1. In addition, if a speech frame is detected, an energy attenuation hangover counter (hangover parameter) g_ho is set to the maximum hangover length MAX_G_HANGOVER. The maximum hangover length may be set according to actual situations, which is not limited in this disclosure. The hangover parameter is set to MAX_G_HANGOVER once a speech frame is detected, and the hangover parameter is decreased by 1 until reaching the predetermined value if a noise frame is detected. The predetermined value may be determined according to specific situations. In this embodiment, for example, the predetermined value is 0.

In order to count the switching frequencies in a certain period, a detection period is required to be set. Specifically, an observation window with a window length of MAX_WINDOW at the unit of frame is used. The window length may be set according to practical situations, which is not limited in this disclosure. In addition, a position counter is provided for recording the position of the currently-received data frame in the observation window. If the current frame reaches the end of the observation window, the VAD switching counter VadSw is smoothed for a long term to obtain a long-term average of the VAD switching frequencies (switching frequency parameter) VadSwtLT=(VadSwtLT+VadSw)/2. Meanwhile, the observation window is shifted by MAX_WINDOW frames, and VadSw is set to 0. In this manner, the switching frequencies in a certain period may be counted according to practical requirements.

If the current frame is a noise frame, when reconstructing background noise by utilizing the CNG technology, the energy attenuation parameter is firstly calculated so as to attenuate the energy of background noise reconstructed through the CNG technology. This operation of energy attenuation may be performed in parameter domain before the operations of synthesizing and filtering, or performed through attenuating the output of the synthesis filter in time domain after the operations of synthesizing and filtering. The energy attenuation parameter is calculated according to the following equation:

$$\text{fact} = \alpha + (1-\alpha)\cdot\frac{\beta\cdot VadSwtLT + \gamma\cdot \text{g_ho}}{\beta\cdot VadSwtLT + \gamma\cdot \text{Max_G_HANGOVER}},$$

where α is the minimum of fact, i.e., a predetermined attenuation coefficient, which is a constant value and used to denote the minimum attenuation degree. The specific value of the attenuation coefficient may be set according to practical situations.

Both β and γ are constant values, which are used respectively to represent the weight of the switching frequency parameter and the hangover parameter in the energy attenuation parameter, i.e., the influence degree on the energy attenuation parameter. If the level of background noise is high, a large value of γ may be set so as to increase the influence of the hangover parameter on the energy attenuation parameter. If the background noise is very unstable, for example, the energy of the background noise is sometimes high and sometimes low, a large value of β may be set so as to increase the influence of the switching frequency parameter on the energy attenuation parameter.

The process for calculating the energy attenuation parameter in this manner is described above. It should be noted that the above equation is just a specific example, and other equations, which are not specifically defined in this disclosure, may also be used as long as the energy attenuation parameter is directly proportional to the sum of the switching frequency parameter and the hangover parameter, and inversely proportional to the sum of the switching frequency parameter and the predetermined maximum hangover length.

It can be seen from the above described embodiments that, if the switching between different types of frames is frequent, the value of VadSwtLT would be large. Moreover, as recited in the above embodiments, the hangover parameter is set to the maximum hangover length once a speech frame is detected, and the hangover parameter is decreased by 1 only if a noise frame is detected. Therefore, due to the frequent switching, i.e. the fast alternating of the speech frame and the noise frame, the value of the hangover parameter is only slightly smaller than the predetermined maximum hangover length and the energy attenuation parameter calculated according to the above equation would be large. It can be seen from the above process of energy attenuation that if the value of the energy attenuation parameter is larger, the attenuation degree would be lower. Thus, if the switching between different types of frames is frequent, lower attenuation degree may be utilized. In contrast, if the switching between different types of frames is infrequent, higher attenuation degree may be utilized. Therefore, the attenuation degree may be associated with the switching frequency of different types of frames, which thus improves the user experience.

According to an embodiment of the present invention, in the process for generating the energy attenuation parameter, the energy attenuation parameter is calculated based on a SID frame interval. The specific process includes: calculating an average interval parameter between the current noise frame and a recently-received noise frame earlier than the current noise frame; and calculating the energy attenuation parameter based on the average interval parameter and a predetermined attenuation coefficient. The energy attenuation parameter is inversely proportional to the average interval parameter.

Specifically, before decoding a frame, the decoder determines the type of the current frame (a speech frame or a noise frame) based on the received parameters, establishes a long-term average record (average interval parameter) sid_dist_lt of the SID frame interval, and updates the long-term SID frame interval by utilizing the interval sid_dist_cur between a SID frame and a previously-received SID frame once receiving the SID frame. The equation for updating is shown as follows:

$$\text{sid_dist_lt}=\delta*\text{sid_dist_lt}+(1-\delta)*\text{sid_dist_cur},$$

where δ is greater than or equal to 0 or smaller than or equal to 1, and denotes an updating speed of the long-term average SID frame interval. If a speech frame is received, the long-term average SID frame interval sid_dist_lt is set to 1.

After the average interval parameter is acquired, the energy attenuation parameter is calculated according to the following equation:

$$\text{fact}=\begin{cases}\alpha+\dfrac{1-\alpha}{\text{sid_dist_lt}} & \text{sid_dist_lt}>K\\ 1 & \text{otherwise.}\end{cases}$$

It can be seen from the above equation that, when the average interval parameter is greater than a predetermined value K, the energy attenuation parameter is inversely proportional to the average interval parameter. If the average interval parameter is smaller than or equal to K, the energy attenuation parameter is 1, that is, no attenuation is performed. K is a predetermined value, which is used to denote a threshold value for the SID frame interval. Thus, if the average interval between two SID frames is large, it indicates that the noise is relatively stable and thus may be attenuated. If the average interval between the two SID frames is small, it indicates that the noise is not stable and thus may not be attenuated. Therefore, the case of large difference between user subjective experiences could be avoided, which thus improves the user experience.

The process for calculating the energy attenuation parameter in this manner is described above. It should be noted that the above equation is just a specific example, and other equations, which are not specifically defined in this disclosure, may also be used as long as the energy attenuation parameter is inversely proportional to the average interval parameter.

According to an embodiment of the present invention, in the process for generating the energy attenuation parameter, the energy attenuation parameter is calculated based on a VAD switching frequency and a SID frame interval. The specific process includes: acquiring a switching frequency parameter and a hangover parameter; calculating an average interval parameter between the current noise frame and a preceding noise frame received recently earlier than the current noise frame; and calculating the energy attenuation parameter based on the switching frequency parameter, the hangover parameter, the average interval parameter, a predetermined attenuation coefficient and the predetermined maximum hangover length. The energy attenuation parameter is directly proportional to the sum of the switching frequency parameter and the hangover coefficient, and the energy attenuation parameter is inversely proportional to the sum of the switching frequency parameter, the predetermined maximum hangover length and the average interval parameter.

Specifically, the decoder decodes the received code stream to obtain parameters, determines the type information of the current frame, and determines whether a switching of VAD occurs. If the preceding frame is a speech frame and the current frame is a noise frame, or if the preceding frame is a noise frame and the current frame is a speech frame, it is determined that the switching of VAD occurs, and then a VAD switching counter VadSw is increased by 1. In addition, if a speech frame is detected, an energy attenuation hangover counter (hangover parameter) g_ho is set to the maximum hangover length MAX_G_HANGOVER. The maximum hangover length may be set according to actual situations, which is not limited in this disclosure. The hangover parameter is set to MAX_G_HANGOVER once a speech frame is detected, and the hangover parameter is decreased by 1 until reaching 0 if a noise frame is detected.

In order to count the switching frequencies in a certain period, a detection period is required to be set. Specifically, an observation window with a window length of MAX_WINDOW at the unit of frame is used. The window length may be set according to practical situations, which is not limited in this disclosure. In addition, a position counter is provided for recording the position of the currently-received data frame in the observation window. If the current frame reaches the end of the observation window, the VAD switching counter VadSw is smoothed for a long term to obtain a long-term average of the VAD switching frequencies (switching frequency parameter) VadSwtLT=(VadSwtLT+VadSw)2. Meanwhile, the observation window is shifted by MAX_WINDOW frames, and VadSw is set to 0. In this manner, the switching frequencies in a certain period may be counted according to practical requirements.

In addition, a long-term average record sid_dist_lt of the SID frame interval is established. Once receiving a SID frame, the long-term SID frame interval is updated by utilizing the interval sid_dist_cur between the SID frame and a previously-received SID frame. The equation for updating is shown as follows:

$$\text{sid_dist_lt}=\gamma*\text{sid_dist_lt}+(1-\gamma)*\text{sid_dist_cur},$$

where δ is greater than or equal to 0 and smaller than or equal to 1, and denotes an updating speed of the long-term average SID frame interval. If a speech frame is received, the long-term average SID frame interval sid_dist_lt is set to 1.

After the average interval parameter and the switching frequency parameter are acquired, the energy attenuation parameter is calculated according to the following equation:

$$\text{fact} = \begin{cases} \alpha + (1-\alpha)\cdot\dfrac{\beta\cdot VadSwtLT + \gamma\cdot \text{g_ho}}{\beta\cdot VadSwtLT + \gamma\cdot \text{MAX_G_HANGOVER} + \text{sid_dist_lt}} & \text{sid_dist_lt} > K \\ 1 & \text{Otherwise} \end{cases}$$

Similarly, when the average interval parameter is greater than a predetermined value K, the energy attenuation parameter is inversely proportional to the average interval parameter. If the average interval parameter is smaller than or equal to K, the energy attenuation parameter is 1, that is, no attenuation is performed. K is a predetermined value, which is used to denote a threshold value for the SID frame interval. Thus, if the average interval between two SID frames is large, it indicates that the noise is relatively stable and thus may be attenuated. If the average interval between the two SID frames is small, it indicates that the noise is not stable and thus may not be attenuated. It should be noted that, this manner possesses the advantages of the preceding two manners, that is, the attenuation is based on both the switching frequency and the noise stability. Therefore, the case of large difference between user subjective experiences could be further avoided, which thus improves the user experience.

The process for calculating the energy attenuation parameter in this manner is described above. It should be noted that the above equation is just a specific example, and other equations, which are not specifically defined in this disclosure, may also be used as long as the energy attenuation parameter is directly proportional to the sum of the switching frequency parameter and the hangover parameter, and inversely proportional to the switching frequency parameter, the predetermined maximum hangover length and the average interval parameter.

Figure 5:
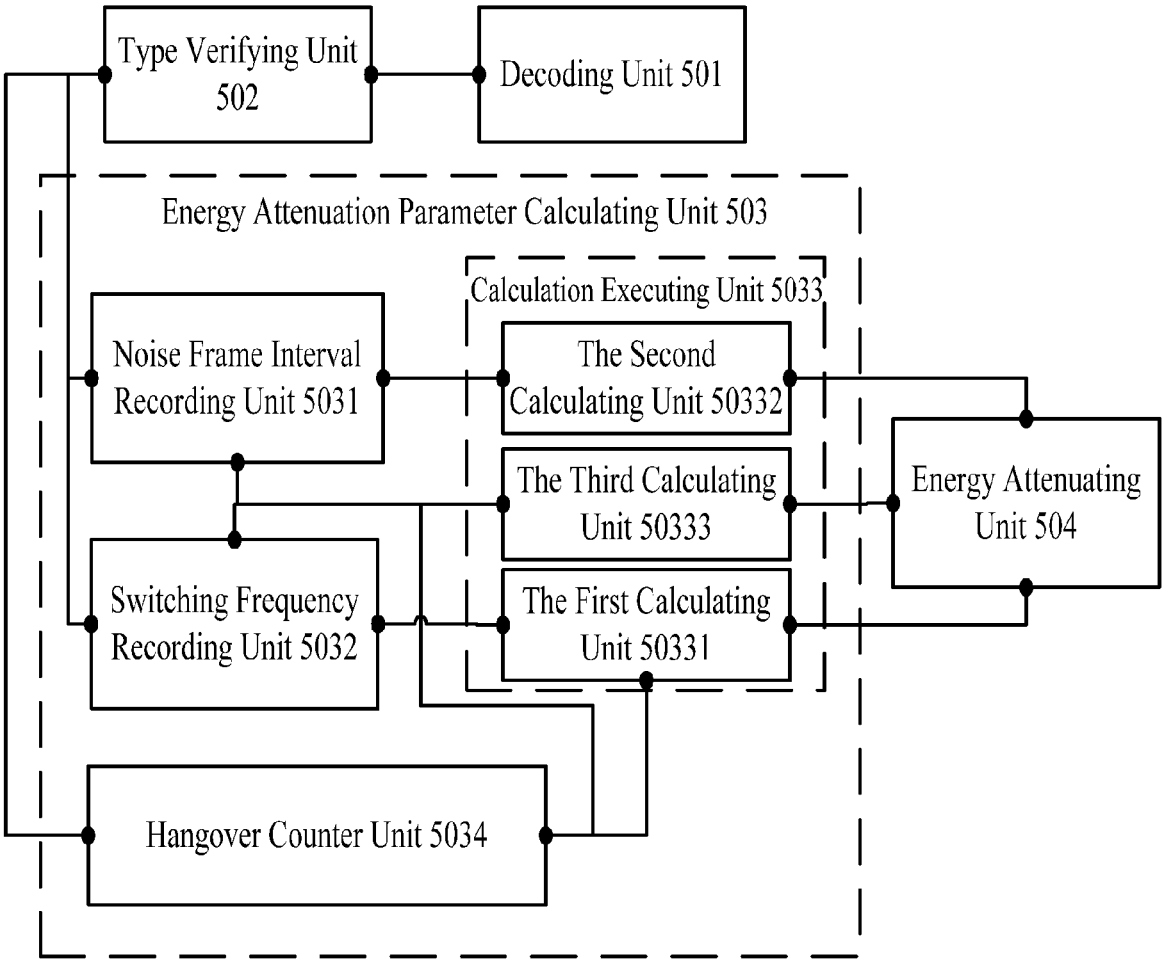
FIG. 5 is a schematic diagram of an apparatus for generating noises according to an embodiment of the present invention.

Referring to FIG. 5, an apparatus for generating noises according to an embodiment of the present invention is described. The apparatus includes: a decoding unit 501, configured to decode a received code stream to obtain a coding parameter and type information of the current data frame; a type verifying unit 502, configured to determine whether the type information indicates that the data frame is a noise frame; an energy attenuation parameter calculating unit 503, configured to, if the current frame is a noise frame, calculate a corresponding energy attenuation parameter based on the noise frame and a data frame received earlier than the noise frame; and an energy attenuating unit 504, configured to attenuate narrowband and/or highband noise energy based on the energy attenuation parameter.

In this embodiment, the energy attenuation parameter calculating unit 503 may further include one or more of the following units: a switching frequency recording unit 5032, configured to determine whether the type of the data frame is different from the type of a recently-received data frame earlier than the data frame, and count a switching frequency parameter if the type of the data frame is different from the type of the recently-received data frame earlier than the data frame; and a hangover counter unit 5034, configured to set a predetermined maximum hangover length to a hangover parameter if the type information indicates that the data frame is a speech frame, and progressively decrease the hangover parameter until reaching a predetermined value if the type information indicates that the data frame is a noise frame.

In this embodiment, the energy attenuation parameter calculating unit 503 may further include: a noise frame interval recording unit 5031, configured to record an average interval parameter between the current noise frame and a recently-received noise frame earlier than the current noise frame based on the type information of the data frame obtained by the decoding unit.

In this embodiment, the energy attenuation parameter calculating unit 503 may further include: a calculation executing unit 5033, configured to calculate the energy attenuation parameter based on the switching frequency parameter and/or the average interval parameter.

In this embodiment, the calculation executing unit 5033 may further include at least one of the following units: a first calculating unit 50331, configured to calculate the energy attenuation parameter based on the switching frequency parameter, the hangover parameter, a predetermined attenuation coefficient and the predetermined maximum hangover length, where the energy attenuation parameter is directly proportional to the sum of the switching frequency parameter and the hangover coefficient, and inversely proportional to the sum of the switching frequency parameter and the predetermined maximum hangover length; a second calculating unit 50332, configured to calculate the average interval parameter between the current noise frame and the recently-received noise frame earlier than the current noise frame, and calculate the energy attenuation parameter based on the average interval parameter and a predetermined attenuation coefficient, where the energy attenuation parameter is inversely proportional to the average interval parameter; and a third calculating unit 50333, configured to calculate the average interval parameter between the current noise frame and the recently-received noise frame earlier than the current noise frame, and calculate the energy attenuation parameter based on the switching frequency parameter, the hangover parameter, the average interval parameter, a predetermined attenuation coefficient and the predetermined maximum hangover length, where the energy attenuation parameter is directly proportional to the sum of the switching frequency parameter and the hangover coefficient, and inversely proportional to the sum of the switching frequency parameter, the predetermined maximum hangover length and the average interval parameter.

In this embodiment, the decoding unit 501 and the type verifying unit 502 are optional units, i.e., the functions of these two units may be implemented by other extra apparatus instead of the apparatus for generating noise.

It should be noted that the energy attenuation parameter calculating unit 503 may calculate the energy attenuation parameter based on the switching frequency, or based on the noise frame interval, or based on both the switching frequency and the noise frame interval. The specific calculation process is similar to that described in detail in the previous embodiments and thus will not be described any more.

In the embodiments of the present invention, when a received data frame is a noise frame, a corresponding energy attenuation parameter is calculated based on the noise frame and a data frame received earlier than the noise frame, and narrowband and/or highband noise energy is attenuated based on the energy attenuation parameter. Therefore, the embodiments of the present invention could calculate the corresponding energy attenuation parameter based on the relationship between the current noise frame and the preceding data frame, and attenuate noise energy based on the energy attenuation parameter. Therefore, this manner of energy attenuation is self-adaptive, and may be adjusted according to the condition of the data frame. Thus, a comfortable noise obtained by this manner of energy attenuation is relatively smooth, which facilitates the improving of user experience.

It should be noted for those skilled in the art that all or part of the steps in the methods according to the above embodiments of the present invention may be implemented by associated hardware that are instructed by programs. The programs may be stored in a computer-readable storage medium, and when executed, the programs cause the following steps: if a received data frame is a noise frame, calculating a corresponding energy attenuation parameter based on the noise frame and a data frame received earlier than the noise frame; and attenuating noise energy based on the energy attenuation parameter so as to obtain a comfortable noise signal. The above mentioned storage medium may be a read-only memory, a magnetic disk, an optical disk, etc.

The method and apparatus for generating noises according to the embodiments of the present invention is described in detail above. It should be noted by those skilled in the art that, according to the principle of the present invention, the specific embodiments and application scopes may be varied. The contents in this disclosure should not be construed as a limitation to the present invention.

What is claimed is:

1. A method for generating noise, comprising:

if a received data frame is a noise frame, acquiring, by a hardware, a switching frequency parameter and a hangover parameter;

calculating by the hardware an energy attenuation parameter based on the switching frequency parameter the hangover parameter a predetermined attenuation coefficient and a predetermined maximum hangover length; and attenuating, by the hardware, noise energy based on the corresponding energy attenuation parameter;

wherein the energy attenuation parameter is directly proportional to the sum of the switching frequency parameter and the hangover parameter and inversely proportional to the sum of the switching frequency parameter and the predetermined maximum hangover length.

2. The method according to claim 1, further comprising:

determining, by the hardware, that a type of a currently-received data frame is different from a type of a received preceding data frame; and counting, by the hardware, a switching frequency parameter.

3. The method according to claim 2, further comprising:

setting, by the hardware, a predetermined maximum hangover length to a hangover parameter if the received data frame is a speech frame; and progressively decreasing, by the hardware, the hangover parameter until reaching a predetermined value if the data frame is the noise frame.

4. The method according to claim 1, wherein attenuating the noise energy based on the energy attenuation parameter comprises:

acquiring an energy parameter of a narrowband core layer;

multiplying the energy parameter of the narrowband core layer by the energy attenuation parameter to obtain the attenuated energy parameter of the narrowband core layer; and calculating an attenuated narrowband signal component based on the attenuated energy parameter of the narrowband core layer.

5. The method according to claim 1, wherein attenuating the noise energy based on the energy attenuation parameter comprises:

acquiring a time domain envelope parameter of a highband core layer and a frequency domain envelope parameter of the highband core layer;

multiplying the time domain envelope parameter of the highband core layer and the frequency domain envelope parameter of the highband core layer by the energy attenuation parameter respectively, to obtain the attenuated time domain envelope parameter of the highband core layer and the attenuated frequency domain envelope parameter of the highband core layer; and calculating an attenuated highband signal component based on the attenuated time domain envelope parameter of the highband core layer and the attenuated frequency domain envelope parameter of the highband core layer.

6. The method according to claim 1, wherein attenuating the noise energy based on the energy attenuation parameter comprises:

acquiring an energy parameter of a narrowband core layer, a spectrum parameter of the narrowband core layer, a time domain envelope parameter of a highband core layer and a frequency domain envelope parameter of the highband core layer;

calculating a narrowband signal component based on the energy parameter of the narrowband core layer and the spectrum parameter of the narrowband core layer;

calculating a highband signal component based on the time domain envelope parameter of the highband core layer and the frequency domain envelope parameter of the highband core layer;

combining the narrowband signal component and the highband signal component to obtain a broadband signal component; and attenuating the broadband signal component based on the energy attenuation parameter.

7. The method according to claim 1, wherein attenuating the noise energy based on the energy attenuation parameter comprises:

acquiring an energy parameter of a narrowband core layer, a spectrum parameter of the narrowband core layer, a time domain envelope parameter of the highband core layer and a frequency domain envelope parameter of the highband core layer;

calculating a narrowband signal component based on the energy parameter of the narrowband core layer and the spectrum parameter of the narrowband core layer;

calculating a highband signal component based on the time domain envelope parameter of the highband core layer and the frequency domain envelope parameter of the highband core layer;

attenuating the narrowband signal component and the highband signal component respectively based on the energy attenuation parameter, to obtain the attenuated narrowband signal component and the attenuated highband signal component; and combining the attenuated narrowband signal component and the attenuated highband signal component to obtain an attenuated broadband signal component.

8. The method according to claim 1, wherein, after calculating the energy attenuation parameter based on the switching frequency parameter, the hangover parameter, the predetermined attenuation coefficient and the predetermined maximum hangover length, the method further comprises:

transmitting a data frame containing the corresponding energy attenuation parameter to a decoding end; and wherein attenuating the noise energy based on the energy attenuation parameter comprises attenuating the noise energy by the decoding end based on the energy attenuation parameter in the received data frame.

9. The method according to claim 1, wherein, after attenuating the noise energy based on the energy attenuation parameter, the method further comprises:

transmitting a data frame with the attenuated noise energy to a decoding end; and generating a comfortable noise signal by the decoding end based on the data frame.

10. An apparatus for generating noises, comprising:

an energy attenuation parameter calculating unit, configured to determine that a received data frame is a noise frame, and calculate a corresponding energy attenuation parameter based on the noise frame and a data frame received earlier than the noise frame; and an energy attenuating unit, configured to attenuate noise energy based on the energy attenuation parameter;

wherein the energy attenuation parameter calculating unit further comprises:

a calculation executing unit, configured to calculate the energy attenuation parameter based on a switching frequency parameter;

the calculation executing unit further comprises:

a first calculating unit, configured to calculate the energy attenuation parameter based on the switching frequency parameter, a hangover parameter, a predetermined attenuation coefficient and a predetermined maximum hangover length;

wherein the energy attenuation parameter is directly proportional to the sum of the switching frequency and the hangover parameter, and inversely proportional to the sum of the switching frequency parameter and the predetermined maximum hangover length.

11. The apparatus for generating noises according to claim 10, further comprising:

a decoding unit, configured to decode a received code stream to obtain type information of the current data frame; and a type verifying unit, configured to determine whether the type information indicates that the data frame is the noise frame.

12. The apparatus for generating noises according to claim 11, wherein the energy attenuation parameter calculating unit further comprises:

a noise frame interval recording unit, configured to record an average interval parameter between the current noise frame and a preceding noise frame received earlier than the current noise frame based on the type information of the data frame obtained by the decoding unit.

13. The apparatus for generating noises according to claim 10, wherein the energy attenuation parameter calculating unit further comprises:

a switching frequency recording unit, configured to determine whether the type of the currently-received data frame is different from the type of the received preceding data frame, and count a switching frequency parameter if the type of the currently-received data frame is different from the type of the received preceding data frame; and a hangover counter unit, configured to set a predetermined maximum hangover length to a hangover parameter if the type information indicates that the data frame is a speech frame, and progressively decrease the hangover parameter until reaching a predetermined value if the type information indicates that the data frame is the noise frame.

* * * * *